US005937754A

United States Patent [19]

Scott et al.

[11] Patent Number: 5,937,754

[45] Date of Patent: Aug. 17, 1999

[54] INK WELL SYSTEM FOR TRANSFER PAD PRINTING MACHINES

[76] Inventors: James R. Scott, 1940 Modds School Rd.; David R. Mosley, 170 Empire Dr., both of Arab, Ala. 35016

[21] Appl. No.: 08/953,465

[22] Filed: Oct. 17, 1997

[51] Int. Cl.[6] ..... B41F 1/00

[52] U.S. Cl. ..... 101/163; 101/169

[58] Field of Search ..... 101/163, 167, 101/169, 335

[56] References Cited

U.S. PATENT DOCUMENTS

| | | | |
|---|---|---|---|
| 4,779,531 | 10/1988 | Ueno et al. | 101/163 |
| 5,052,293 | 10/1991 | Berberich | 101/163 |
| 5,456,170 | 10/1995 | Bachmann | 101/35 |
| 5,577,442 | 11/1996 | Tanaka et al. | 101/163 |

*Primary Examiner*—Edgar Burr
*Assistant Examiner*—Dave Ghatt
*Attorney, Agent, or Firm*—Lyon Harr & DeFrank

[57] ABSTRACT

The present invention is embodied in an ink well assembly for use with a transfer pad or tampon printing machine having a image plate. The ink well assembly of the present invention includes an ink reservoir for holding ink, a receiving area for securing the image plate in a sealed relationship with the ink, a plurality of adjusters for securely urging the image plate within the receiving area, and a plurality of fasteners unexposed to the ink. The unexposed fasteners secure component parts without exposing the fasteners to the ink to allow easy set up, cleaning, disassembly and reassembly, elimination of ink leaks, and incorporation with the pad printing machine without significant machine downtime.

9 Claims, 5 Drawing Sheets

INK WELL SYSTEM FOR TRANSFER PAD PRINTING MACHINES

BACKGROUND OF THE INVENTION

1. Field of the Invention

The present invention relates in general to printing systems and in particular to an ink well assembly for pad printing machines.

2. Related Art

Transfer pad printing machines or tampon printing machines have been used for many years for placing decorative markings, such as text and/or designs, on the surfaces of parts with a special ink. The special ink contains adhesive agents and typically dries as a hardened epoxy. This ensures proper adhesion of the ink to the printed surface and also promotes longevity of the decorative marking.

Transfer pad printing is extremely useful and versatile because it can be used to print desired images onto many types of substrate surfaces, such as wood, plastic, glass, metal, fabric, paper, etc. Also, desired images can be printed on numerous surface shapes, such as flat, round, curved, angled, or recessed surfaces, with transfer pad printing. Further, the desired images can be printed on these surfaces in multicolor, wet-on-wet inkings, without drying between colors. Some transfer pad printing applications include printing on automotive and electronic parts and outdoor recreational equipment, producing cosmetic color coding, producing point-of-purchase retail advertising and incentive and promotional material, etc.

A transfer pad printing machine typically includes a printing pad, an image plate having an image engraved thereon, and an ink well having ink located in a reservoir. The image plate is coupled to the ink well for providing ink in the engraved areas of the plate. Current ink wells are usually comprised of mating parts that are connected with fasteners and wedges that secure the image plate within the ink well. These ink wells typically require the use of caulking and silicone sealant around exposed wedges to seal and secure the image plate within the ink well. The wedges are used to move the image plate within an image plate holding area. The caulking and silicone sealant is used to limit the leaking of the ink. Ink is first flooded across the surface of the image plate and then excess ink is cleared from the non-engraved areas of the plate with a special blade, thereby leaving ink in only the engraved area. Next, the printing pad contacts the image plate in the engraved area and then contacts the surface of the substrate, thereby transferring the ink to the surface of the substrate to create a printed recreation of the desired image on the substrate.

However, current ink wells used in printing machines are lacking in several areas. For instance, current ink wells are expensive to make, maintain, and clean, which causes significant machine downtime. This is because current ink wells have numerous parts and are assembled with numerous fasteners, wedges, and sealants. The fasteners, wedges, and sealants are completely exposed to the ink, Since the ink typically used for pad printing machines dries as a hardened epoxy, current ink wells must be completely disassembled and cleaned by chiseling and scraping the ink from the ink well. As a result, the fasteners and wedges are regularly bent, disfigured, and/or damaged during chiseling and scraping of the ink and the sealant must be removed and reapplied after each use. Also, the fasteners, wedges, and sealants usually contain excessive build-up of ink, and thus require frequent replacement. These problems cause the use of additional labor and materials and create wasted downtime.

In addition, since current ink wells must be completely disassembled and cleaned after each ink change, these ink wells have a tendency to leak during reuse, after the ink wells are reassembled. This is caused by poor seals of mating parts and improper fitting of the fasteners, wedges, and sealants due to excessive ink build-up on exposed areas. Because the ink typically used for pad printing machines dries as a hardened epoxy, the hardened epoxy usually causes gaps and cracks around the wedges and the mating parts using the exposed fasteners to connect the parts. Consequently, the gaps and cracks cause the ink to leak around the wedges, the exposed fasteners, and mating parts.

Therefore, what is needed is a new ink well assembly that is easy to set up, clean, and incorporate with a pad printing machine without significant machine downtime. What is also needed is a new ink well assembly that is inexpensive and requires less parts. What is additionally needed is a new ink well assembly that doesn't leak ink. What is further needed is a new ink well assembly that does not require caulking, silicone adhesives, or wedges to seal or secure the image plate.

Whatever the merits of the above mentioned systems and methods, they do not achieve the benefits of the present invention.

SUMMARY OF THE INVENTION

To overcome the limitations in the prior art described above, and to overcome other limitations that will become apparent upon reading and understanding the present specification, the present invention is embodied in an ink well assembly for use with a transfer pad or tampon printing machine having a image plate.

The ink well of the present invention is a multi-part ink well assembly comprising an ink reservoir for holding ink, a receiving area for securing the image plate within the receiving area, and a plurality of fasteners unexposed to the ink. The fasteners secure the multi-parts of the ink well assembly together. Also included are a plurality of adjusters for securely urging and sealing the image plate within the receiving area.

A feature of the present invention is the unexposed fastener system for securing component parts without exposing the fasteners to the ink. Another feature of the present invention is the elimination of ink leaks. Yet another feature of the present invention is the elimination of the use of caulking, silicone adhesives, or wedges to seal or secure the image plate. An advantage of the present invention is that it is easy to set up and incorporate with a pad printing machine without significant machine downtime. Another advantage of the present invention is that it is inexpensive and requires less parts. Yet another advantage of the present invention is that it is easy to clean and disassemble and reassemble.

The foregoing and still further features and advantages of the present invention as well as a more complete understanding thereof will be made apparent from a study of the following detailed description of the invention in connection with the accompanying drawings and appended claims.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Figure 1:
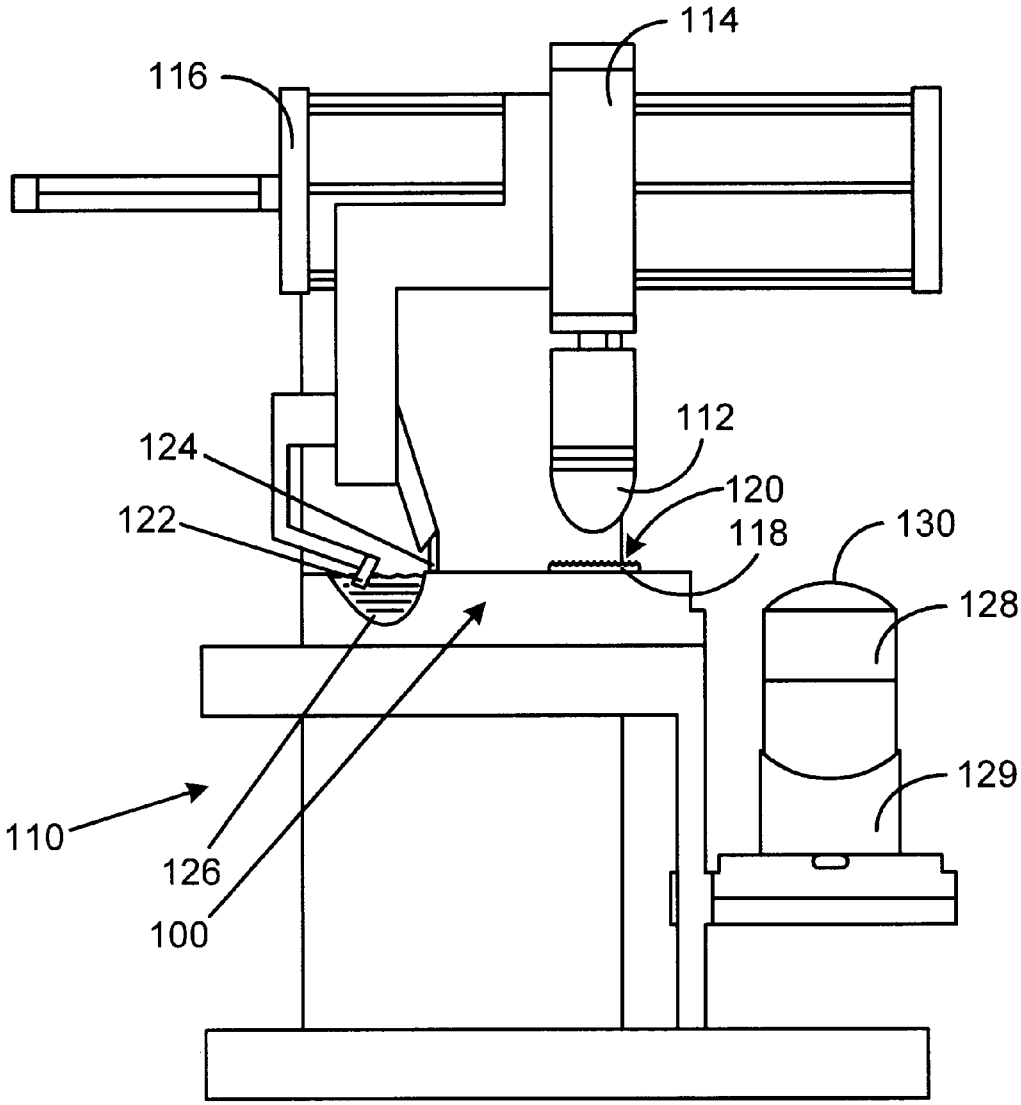
FIG. 1 is an overview of the present invention.

Overview:

FIG. 1 is a perspective view of the ink well assembly of the present invention. The ink well assembly 100 of the present invention is compatible with typical transfer pad printing machines 110. The transfer pad printing machine 110 utilized with the present invention preferably includes a printing pad 112 connected to a vertical module 114, a horizontal module 116, an image plate 118 with an image 120 etched or engraved thereon, a flood device 122, a clearing device 124, ink 126 located in the ink well assembly 100, and a substrate 128 located in a substrate holder 129. The vertical and horizontal modules 114, 116 are preferably automatic pneumatic cylinders.

The printing pad 112 is the element that transfers the ink 126 in the form of the image 120 from the image plate 118 to the substrate 128. The printing pad 112 is typically made of silicon rubber and can have a custom shape, depending on the shape of the substrate 128. For example, if a surface 130 of the substrate 128 to be printed on had a convex surface, the printing pad 112 could also have a convex surface. This would ensure encompassing contour contact between the printing pad 112 and the convex surface of the substrate 128 and allow the printing pad 112 to compress as it contacted the substrate 128.

The image plate 118, commonly referred to as a cliche, is usually either a polymer plate or a steel plate, such as a hardened high-alloy tool steel or any other suitable printing plate. Polymer plates can be used for small-production runs, while steel plates can be used for high-production runs. The image 120 is etched or engraved on the image plate 118 in a likeness identical to that of the desired image to be printed on the substrate 128. The image plate 118 has a precise surface finish and can be etched or engraved with the image 120 with techniques well known to those skilled in the art and will not be described hereinafter in greater detail.

The flood device 122 can be any suitable device, such as a flood bar, for scooping ink 126 from the ink well assembly 100 in order to flood the image plate 118 with ink 126. The clearing device 124 can be any suitable device for clearing excess ink from the image plate 118, with the exception of the image 120. The clearing device 124 can be a doctor blade made of a material that allows it to clear ink 126 off non-image areas of the image plate 118, while not damaging the image plate 118 or the engraved or etched image 120. Both the flood device 122 and the clearing device 124 are connected to the horizontal module 116.

Figure 3:
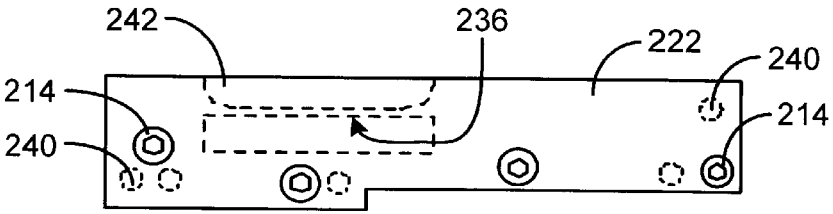
FIG. 3 is an exploded side view of the side bars of the ink well assembly illustrating the fasteners and the side bars of the present invention.
Figure 4:
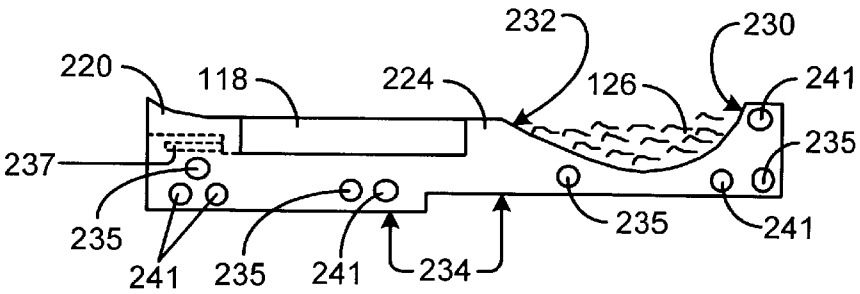
FIG. 4 is an exploded side view of the main base of the ink well assembly illustrating the ink reservoir and receiving areas with an image plate.
Figure 2:
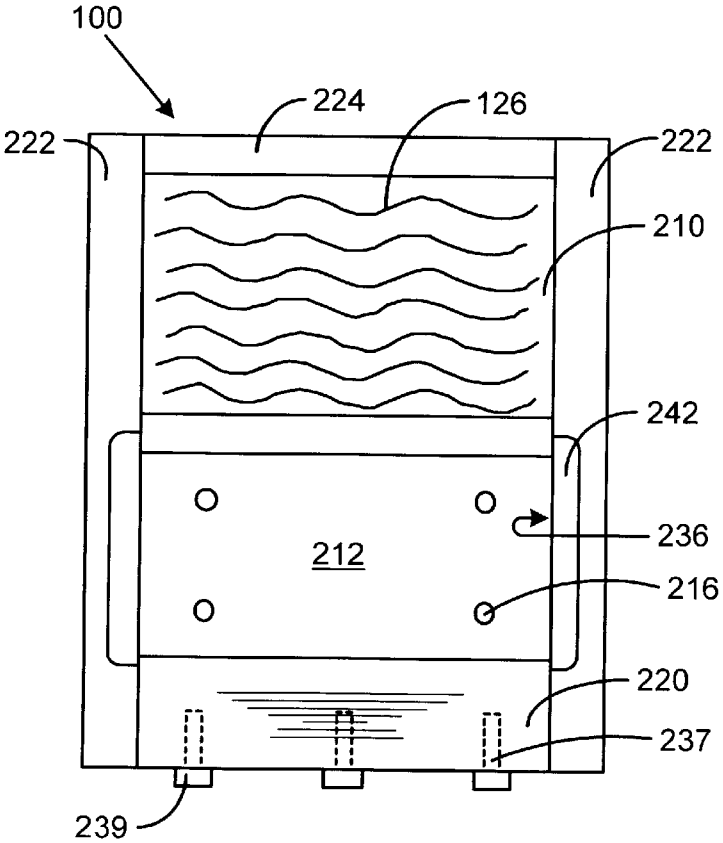
FIG. 2 is a top view of the ink well assembly of the present invention.

Details of the Ink Well System:

FIG. 2 is a top view of the ink well assembly of the present invention, FIG. 3 is a side view of the ink well assembly illustrating the fasteners and the side bars of the present invention, and FIG. 4 is a side view of the ink well assembly without the side bars showing the ink reservoir and receiving area. The ink well assembly 100 of the present invention in general includes an ink reservoir 210 for holding ink 126, a receiving area 212 for securing the image plate 118 within the receiving area 212, and a plurality of fasteners 214 unexposed to the ink 126 so that they are safe from ink contamination. The fasteners 214 secure multi-parts of the ink well assembly 100 together. Also included are a plurality of adjusters 216 for securely urging the image plate 118 within the receiving area 212.

Working Example:

As a specific working example, the ink well assembly can comprise four multi-parts, a front urging bar 220, two symmetrically opposed side bars 222, and a main base 224. In addition, the ink well assembly 100 has locking mechanisms (not shown) located on a bottom side 234 of the main base 224. The locking mechanisms allow the ink well assembly 100 to securely lock into the transfer pad printing machine 110 and can be of the type well known to those skilled in the art and will not be described hereinafter in greater detail. The multi-parts are held securely together by the unexposed fasteners 214. The unexposed fasteners 214 are preferably recessed alien screws connectable to receiving holes 235.

The main base 224 is defined by the ink reservoir 210 and the receiving area 212. The ink reservoir 210 preferably has a concave back portion 230 with a slightly inclined front slope 232, as shown in FIG. 4. The receiving area 212 preferably has a shape similar to the image plate 118, such as a rectangular shape. The receiving area 212 also preferably has a plurality of adjusters 216, which can accessed from a bottom side 234 of the main base 224. The adjusters 216 can be adjusted to urge the image plate 118 upward within the receiving area against respective lips 236 of the side bars 222, thereby forcing the image plate 118 into a secure sealed relationship within the receiving area 212. This secure sealed relationship prevents any ink located in the receiving area 212 from penetrating into areas around and below the image plate 118.

Referring to FIG. 3, the symmetrically opposed side bars 222 are securely connected to the main base 224 via the fasteners 214. The side bars 222 can have male dowel pins 240 for precise mating with the main base 224 via female dowel holes 241. Each side bar 222 can also have a tapered portion 242 located above the receiving area 212. The tapered portion 242 allows the clearing device 124 of FIGS. 1 and 5A–5F to smoothly clear the ink 126 from the image plate 118 (operation of the clearing device 124 is discussed in detail in below with reference to FIGS. 5A–5F).

As shown in FIGS. 2 and 4, the front urging bar 220 is located adjacent the receiving area 212. The front urging bar 220 preferably has a plurality of front adjusters 237 with ink covers 239, which can be plastic thumb screws for protecting the front adjusters 237 from ink contamination. The front adjusters 237 urge the front bar against the image plate 118 to force the image plate 118 into a secure relationship within the receiving area 212. This secure sealed relationship prevents the ink 126 from penetrating into areas around and below the image plate 118. In addition, for ease of assembly, disassembly, reassembly, and general use, the fasteners and all of the adjusters 216, 237 can be of the same size so that only one tool, such as an allen wrench, is used to tighten and loosen all fasteners and adjusters.

The ink well assembly 100 of the present invention is easily adaptable for use with standard transfer pad printing machines. The locking mechanisms of the ink well assembly 100 allow quick and easy attachment and detachment of the ink well assembly 100 from standard transfer pad printing machines. Also, the image plate 118 can be quickly inserted into the ink well assembly 100 for easy set up. This can be accomplished by first detaching one of the side bars 222 by removing corresponding hidden fasteners 214, second placing the image plate 118 within the receiving area 212, third reattaching the side bar 222, and fourth securing and sealing the image plate 118 by tightening all adjusters 216, 237.

The image plate 118 can be removed from the ink well assembly 100 when a print job is finished by first removing all excess ink, second unsecuring and unsealing the image plate 118 by loosening all adjusters 216, 237 third detaching one of the side bars 222 by removing corresponding hidden fasteners 214, fourth removing the image plate 118 from the receiving area 212, and fifth reattaching the side bar 222. Thus, disassembly and reassembly of the ink well assembly 100 is quick and easy.

Figure 5A:
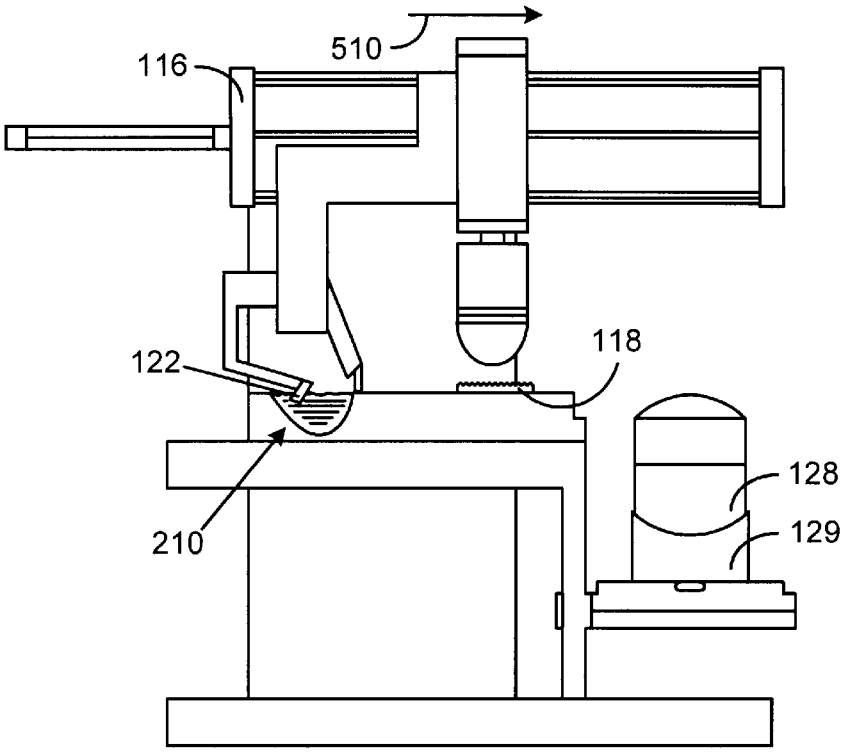
FIGS. 5A–5F are perspective views of the steps in the operation of the present invention.
Figure 5B:
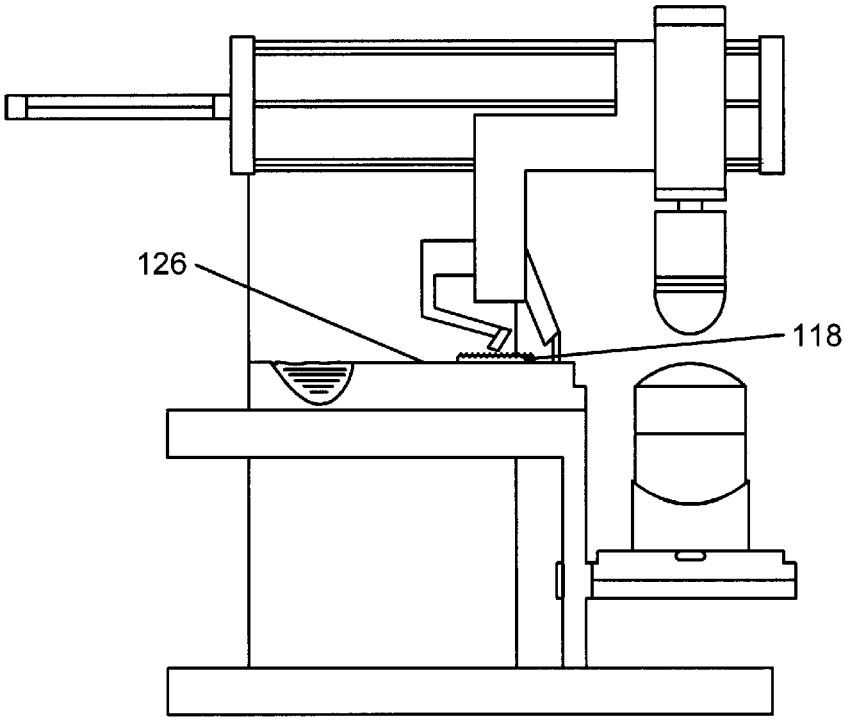
Figure 5C:
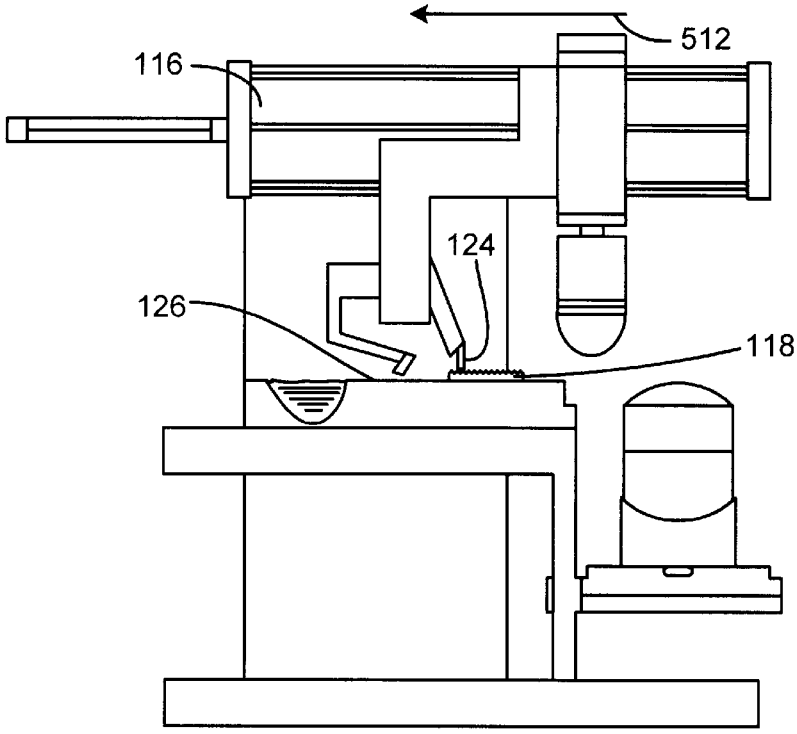

Operation:

FIGS. 5A–5F are perspective views of the steps in the operation of the present invention. First the flood device 122 is located within the ink reservoir 210 of the ink well assembly as shown in FIG. 5A. Second, the horizontal module 116 is activated to move in a horizontal direction indicated by arrow 510. This causes the flood device 122 to sweep across the ink reservoir 210, thereby flooding the image plate 118 with ink 126, as shown in FIG. 5B. Third, the horizontal module 116 is activated to move in a horizontal direction indicated by arrow 512. This causes the clearing device 124 to sweep across the image plate 118, thereby clearing ink 126 from non-image areas of the image plate 118, as shown in FIG. 5C.

Figure 5D:
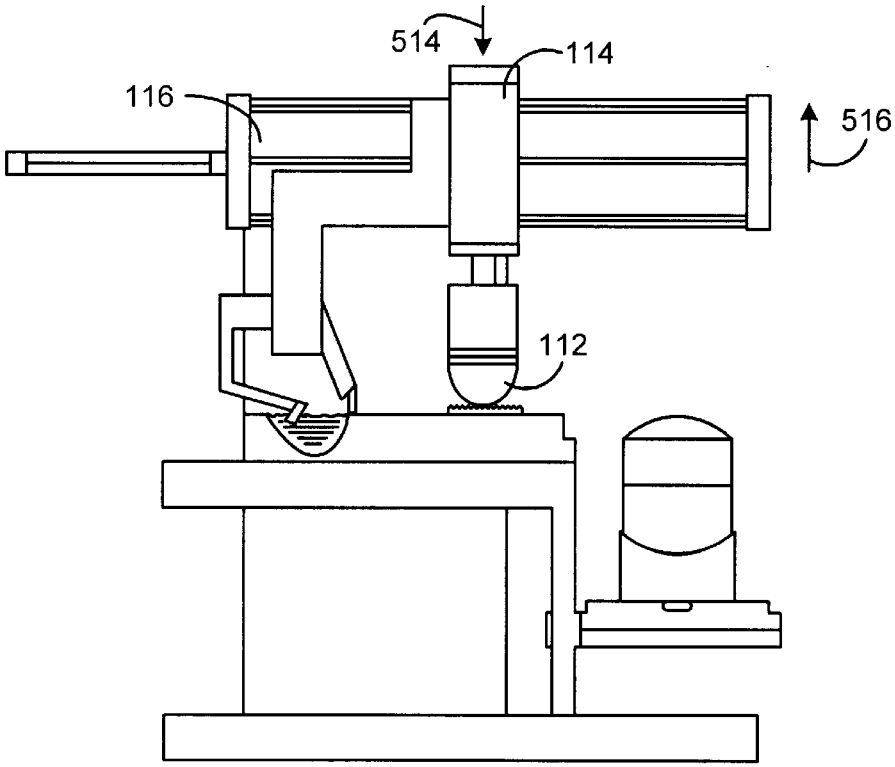
Figure 5E:
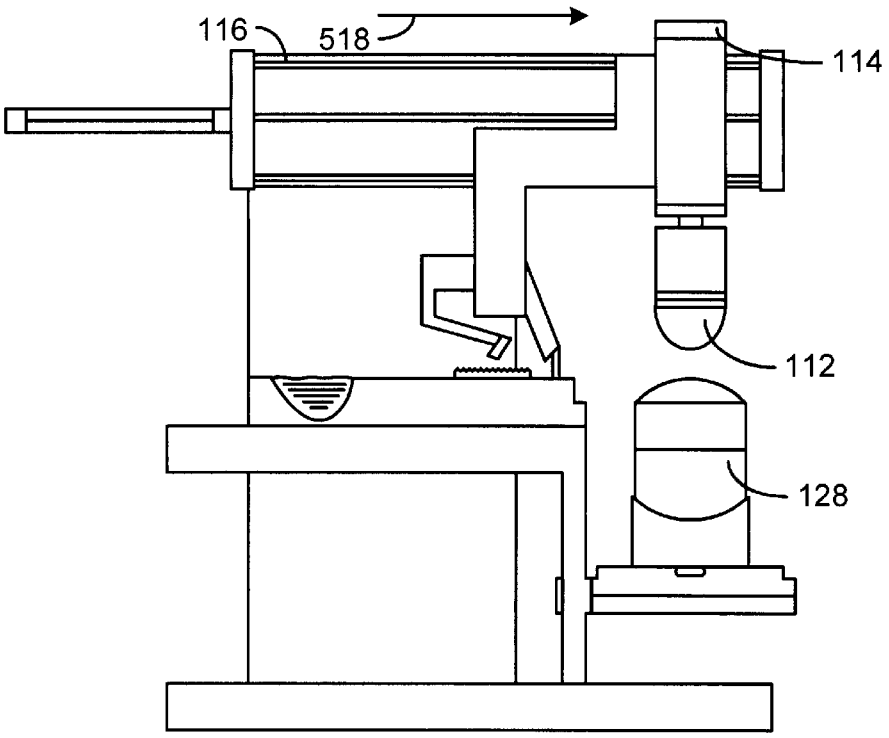
Figure 5F:
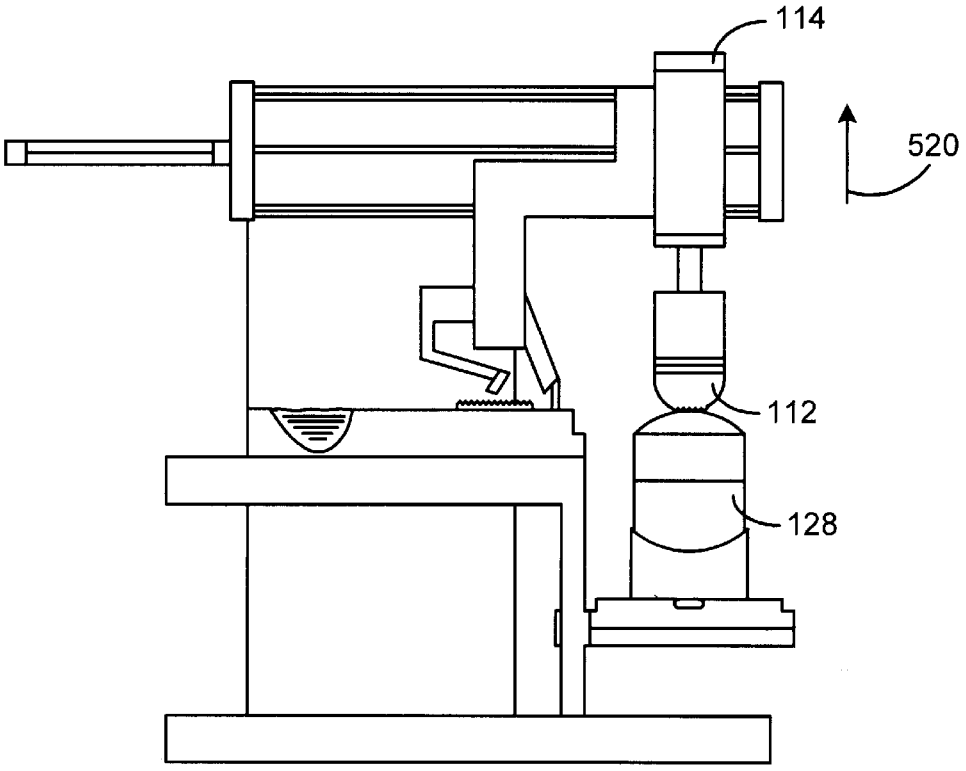

The horizontal module 116 initiates horizontal movement, as shown in FIG. 5C, so that the printing pad 112 returns to a location directly over the image 120 of the image plate 118, as shown in FIG. 5A. Next, the vertical module 114 is activated to move in a vertical direction indicated by arrow 514. This causes the printing pad 112 to compress on the image 120 of the image plate 118 and collect an ink pattern of the image 120, as shown in FIG. 5D. The vertical module 114 is then activated to lift the printing pad 112 from the image plate 118 in a vertical direction indicated by arrow 516. Next, the horizontal module 116 is activated to move in a horizontal direction indicated by arrow 518 so that the printing pad 112 is located directly over a selected area of the substrate 128, as shown in FIG. 5E. The vertical module 114 is then activated to move in a vertical direction indicated by arrow 520. This causes the printing pad 112 to compress on the surface 130 of the substrate 128, thereby printing the ink pattern collected by the printing pad 112, representing the image 120, onto the selected surface 130 area of the substrate 128, as shown in FIG. 5F. Last, a new substrate 128 is placed within the substrate holder 129 and the cycle of FIGS. 5A–5F described above is repeated for as many substrates 128 as desired.

Conclusions:

The ink well assembly of the present invention is easier to set up, tear down, maintain, and clean than current ink well systems. The present invention eliminates the need for caulking, silicone adhesive, or wedges associated with current ink well systems. Because sealants and wedges are not used in the present invention, less scraping and beating is required to disassemble the ink well assembly. For example, when a job is finished, the ink in the ink reservoir of the ink well assembly of the present invention would simply be poured out and all excess ink would be wiped clean, instead of disassembling and reassembling wedges and parts, like current ink wells.

In addition, the present invention utilizes a new fastener system for securing component parts without having the fasteners exposed to the ink. Consequently, the present invention is not susceptible to misaligned fasteners and ink leaks, like the current ink well systems. Current ink wells are prone to misaligned fasteners and ink leaks because the ink dries around and inside disassembling fastener areas, causing altered reassembly. Also, if ink was splattered or spilled on the outer parts of the ink well assembly of the present invention, easy disassembly and reassembly of all parts can be accomplished with the unexposed fastener system of the present invention. Therefore, the present invention provides an inexpensive and reliable ink printing system that reduces machine downtime.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An ink well assembly coupled to a transfer pad printing machine with a image plate having an image thereon, comprising:

a reservoir for holding ink;

a plurality of fasteners unexposed to said ink for securing the ink well assembly together;

a receiving area having a plurality of adjusters for urging the image plate within the receiving area to create a sealed relationship for preventing ink from penetrating into areas around and below the image plate; and a front bar with adjusters for securely urging the image plate within the receiving area, said front bar being located adjacent to said receiving area.

2. The ink well assembly of claim 1, further comprising protector caps for protecting said adjusters of said front bar from ink contamination.

3. An ink well assembly coupled to a transfer pad printing machine with a image plate having an image thereon, comprising:

a reservoir for holding ink;

a plurality of fasteners unexposed to said ink for securing the ink well assembly together;

a receiving area having a plurality of adjusters for urging the image plate within the receiving area to create a sealed relationship for preventing ink from penetrating into areas around and below the image plate; and wherein said reservoir and said receiving area are defined by a main base, wherein the ink well assembly further comprises two symmetrically opposed side bars located adjacent to said main base, wherein said side bars are removably attachable to respective sides of said main base with said hidden fasteners.

4. The ink well assembly of claim 3, wherein each side bar includes a stop face located adjacent to the image plate, wherein said adjusters urge the image plate against said stop faces to form a compressive seal between the image plate and said receiving area.

5. The ink well assembly of claim 3, further comprising a front bar with front adjusters for securely urging and sealing the image plate within said receiving area, said front bar being located adjacent to said receiving area.

6. The ink well assembly of claim 3, wherein each side bar includes a plurality of guiding devices for precisely guiding said assembly together.

7. The ink well assembly of claim 6, wherein said guiding devices are dowel pins and matching dowel receiving holes.

8. A method for transferring the likeness of an image from an image plate of a pad printing machine to a substrate with ink, comprising the steps of:

urging the image plate within a receiving area so that the image plate is placed into a sealed relationship with said receiving area to prevent said ink from penetrating into areas around and below the image plate;

holding the image plate securely within said receiving area with a plurality of fasteners located in an area protected from exposure to said ink;

flooding the image plate with ink;

clearing said ink from the image plate and leaving sufficient ink on the image; and transferring ink from the image of the image plate onto said substrate.

9. The method of claim 8, wherein the image plate is sealed within said receiving area of said ink well by a front bar and bottom adjusters.

* * * * *